US007285943B2

(12) United States Patent
Migliavacca

(10) Patent No.: US 7,285,943 B2
(45) Date of Patent: Oct. 23, 2007

(54) METHOD OF FORMING A REFERENCE VOLTAGE AND STRUCTURE THEREFOR

(75) Inventor: Paolo Migliavacca, Mauzac (FR)

(73) Assignee: Semiconductor Components Industries, L.L.C., Phoenix, AZ (US)

( * ) Notice: Subject to any disclaimer, the term of this patent is extended or adjusted under 35 U.S.C. 154(b) by 470 days.

(21) Appl. No.: 10/512,767

(22) PCT Filed: Apr. 18, 2003

(86) PCT No.: PCT/US03/12082

§ 371 (c)(1),
(2), (4) Date: Oct. 28, 2004

(87) PCT Pub. No.: WO2004/099892

PCT Pub. Date: Nov. 18, 2004

(65) Prior Publication Data

US 2006/0028193 A1 Feb. 9, 2006

(51) Int. Cl.
*G05F 1/573* (2006.01)

(52) U.S. Cl. ..... 323/277; 323/281

(58) Field of Classification Search ..... 323/282, 323/312, 313, 316, 265, 266; 307/234, 310, 307/491, 315; 327/536, 540, 537, 534; 330/289, 330/256

See application file for complete search history.

(56) References Cited

U.S. PATENT DOCUMENTS 4,772,793 A * 9/1988 Larson et al. ..... 250/374
5,920,182 A * 7/1999 Migliavacca ..... 323/282

* cited by examiner

*Primary Examiner*—Rajnikant B. Patel
(74) *Attorney, Agent, or Firm*—Robert F. Hightower

(57) ABSTRACT

A selected bandgap reference (11) of a voltage generator (10) is operated at a duty cycle that is less than one hundred percent. The seclectable bandgap reference (11) has at a high current consumption when enabled and a low current consumption when disabled. The output voltage of the selectable bandgap reference (11) is stored on a storage element (13) when the selectable bandgap reference (11) is enabled. A high impedance amplifier (16) receives the stored voltage and generates the reference voltage.

19 Claims, 5 Drawing Sheets

METHOD OF FORMING A REFERENCE VOLTAGE AND STRUCTURE THEREFOR

BACKGROUND OF THE INVENTION

The present invention relates, in general, to electronics, and more particularly, to methods of forming semiconductor devices and structure.

In the past, the semiconductor industry utilized various methods and structures to form bandgap regulators. Typically these bandgap regulators utilized two dissimilar sized bipolar transistors as the basis of the bandgap regulator. Typically, a resistor was connected in series between the emitter of the larger transistor and the power source. The voltage developed across the resistor, and amplified by the ratio of the resistors, was utilized as a part of the stable bandgap reference voltage. In some applications it was desirable to have low power dissipation thus, the bandgap regulator was operated at low current levels, such as currents of less than two (2) micro-amps. At low current levels offset voltages developed at the input of the amplifier used to amplify the voltage across the resistor. These offset voltages resulted in an inaccurate reference voltage. Typically these offsets resulted in an error of at least approximately plus or minus four percent (4%).

At these low current levels, leakage current of the devices became a larger percentage of the current flow through the bipolar transistors and added to the inaccuracy of the reference voltage. These leakage currents typically resulted in an additional inaccuracy of up to approximately one or two percent (1%-2%).

Additionally, the low current operation also degraded the power supply rejection ratio (PSRR) of these bandgap regulators. At low currents, the pole of the PSRR of the bandgap regulator moved to lower frequencies and resulted in a more noisy output voltage.

A further problem was the area required to form these prior bandgap regulators. In order to minimize power dissipation, the size of the resistors had to be increased thereby increasing the cost of the bandgap regulator.

Accordingly, it is desirable to have a bandgap regulator that operates at low currents in order to achieve low power dissipation, that has an accuracy greater than plus or minus four percent (4%), that minimizes leakage current effects, that has an improved power supply rejection ratio, and that does not utilize larger resistor values that consume large amounts of area.

For simplicity and clarity of illustration, elements in the figures are not necessarily to scale, and the same reference numbers in different figures denote the same elements. Additionally, descriptions and details of well known steps and elements are omitted for simplicity of the description. As used herein current carrying electrode means an element of a device that carries current through the device such as a source or a drain of an MOS transistor or an emitter or a collector of a bipolar transistor, and a control electrode means an element of the device that controls current through the device such as a gate of an MOS transistor or a base of a bipolar transistor.

DETAILED DESCRIPTION OF THE DRAWINGS

Figure 1:
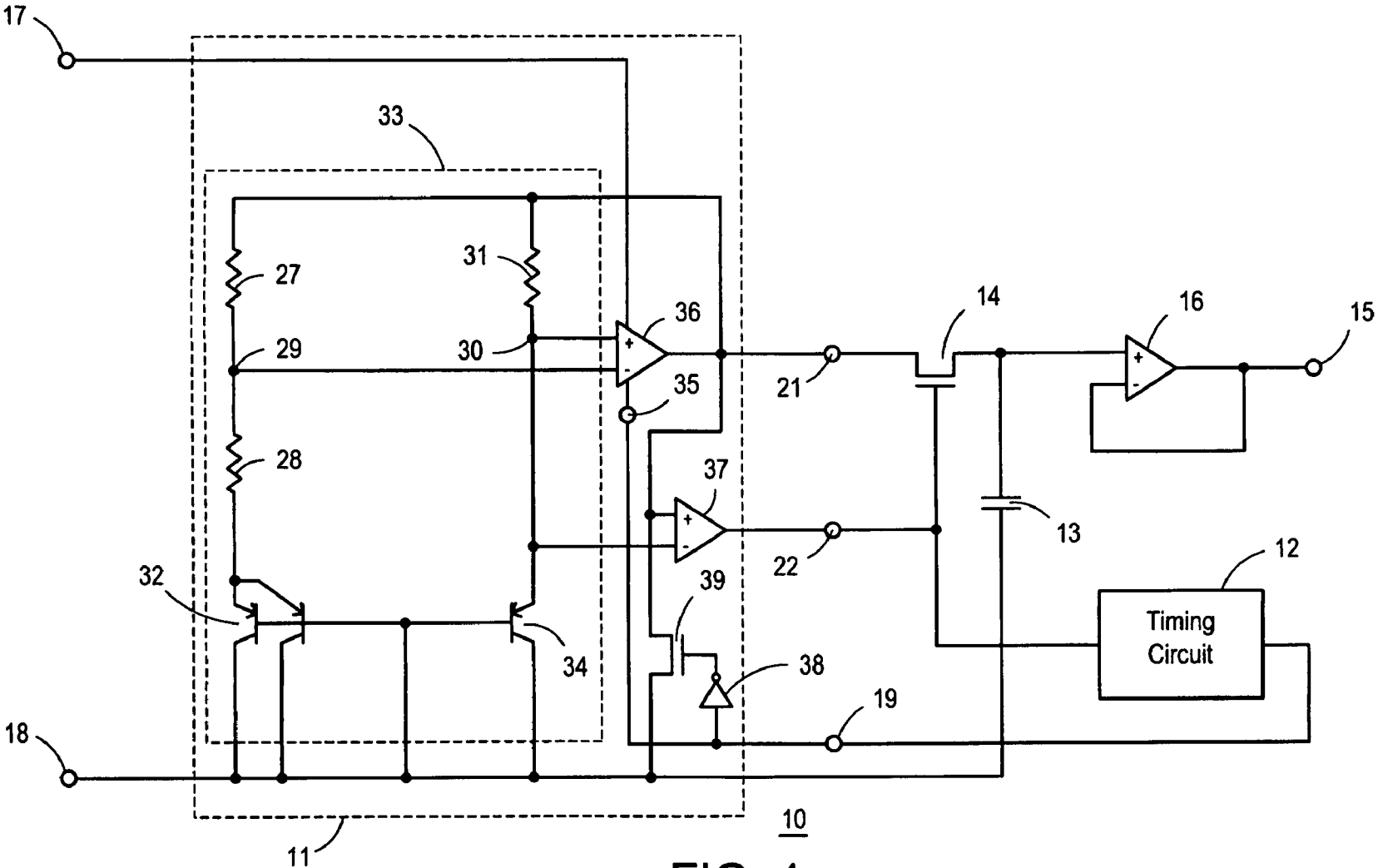
FIG. 1 schematically illustrates an embodiment of a portion of a bandgap reference generator in accordance with the present invention.

FIG. 1 schematically illustrates a portion of an embodiment of a reference voltage generator 10 that has low power dissipation and produces an accurate reference voltage on a reference output 15. Generator 10 includes a selectable bandgap reference 11 that is operated by generator 10 at a duty cycle of less than one hundred percent (100%). Generator 10 selectively enables and disables reference 11 with a duty cycle that is determined by a timing circuit 12 of generator 10. Reference 11 is formed to generate a bandgap output voltage on an output 21 when reference 11 is enabled. Reference 11 also includes an enable input 19, a reference cell 33, a selectable reference amplifier 36, a reference comparator 37, a disable transistor 39, an inverter 38, and a voltage valid output 22. Reference 11 is formed to operate at a high current level and high power consumption level when reference 11 is enabled, and to have low current consumption when reference 11 is disabled or not enabled. Operating reference 11 at high current levels when enabled eliminates the low current offset effects and assists in providing the accurate reference voltage on output 15, and operating reference 11 at a low duty cycle reduces the power dissipation of generator 10. Typically, reference 11 has a current consumption of at least thirty (30) micro-amps when reference 11 is enabled. Amplifier 36 receives a timing signal or an enable signal from input 19 on an enable input 35 of amplifier 36. When enable input 35 is low, amplifier 36 is disabled and when input 35 is high amplifier 36 is enabled. As is well known in the art, an amplifier has current sources that bias transistors internal to the amplifier. Selectable amplifier 36 is disabled or enabled by disabling or enabling, respectively, the current sources internal to amplifier 36. Disabling the current sources prevents amplifier 36 from operating and from supplying current, except for leakage current, to any load connected to the output of amplifier 36.

Generator 10 also includes a storage element 13, a storage switch or transistor 14, and an amplifier 16. Storage transistor 14 is used to selectively couple output 21 to element 13 in order to store the value of the bandgap output voltage onto element 13 while reference 11 is enabled. The voltage stored on element 13 is utilized to maintain the reference voltage on output 15 when reference 11 is disabled. Amplifier 16 receives the voltage stored on element 13 and drives output 15 with the value of the reference voltage in order to generate the reference voltage value on output 15. Amplifier 16 preferably has a high input impedance in order to maintain the voltage stored on element 13. The input impedance generally is at least about one hundred (100) Gigaohms. In the preferred embodiment, amplifier 16 is a voltage follower that is formed with MOS transistors and that has a gain of approximately one so that the value of the reference voltage on output 15 is substantially equal to the value of the voltage on element 13.

In the preferred embodiment, reference cell 33 is formed to include a first reference transistor 32 and a second reference transistor 34. Transistor 32 is coupled to output 21 through series connected resistors 27 and 28. A node 29 is formed where resistors 27 and 28 are connected together. Transistor 34 is coupled to output 21 through a series connected resistor 31. A node 30 is formed at the connection between resistor 31 and transistor 34. As is well known in the art, transistors 32 and 34 are formed to have different sizes with transistor 32 being larger than transistor 34 as illustrated by the transistor symbols. Those skilled in the art understand that cell 33 is a simplified representation of a bandgap cell and that cell 33 typically includes other well known elements of a bandgap reference.

Timing circuit 12 is formed to generate the timing signal or enable signal that is applied to enable input 19. Timing circuit 12 typically forms the enable signal as a pulse with an asymmetrical waveform that is periodically generated. The duty cycle is less than one hundred percent (100%) and generally is less than fifty percent (50%). In the preferred embodiment, the duty cycle is less than approximately three percent (3%).

When the enable signal on input 19 goes high, amplifier 36 is enabled to supply current to transistors 32 and 34 and to corresponding resistors 27, 28, and 31. The high enable signal on input 19 also disables transistor 39 in order to facilitate the current flow from the output of amplifier 36. As current from amplifier 36 flows through transistors 32 and 24 and through resistors 27, 28, and 31, a voltage that is approximately equal to a difference in the base-emitter voltages of transistors 32 and 34 is formed across resistor 28. This voltage is commonly referred to as a delta Vbe voltage. Reference amplifier 36 equalizes the voltage of nodes 29 and 30, which allows amplifier 36 to amplify the delta Vbe voltage in order to form the bandgap output voltage on output 21. The voltage formed on node 30 is an internal voltage that is referred to as a Vbe voltage. Reference comparator 37 compares the value of the bandgap output voltage to the value of the Vbe voltage or internal voltage on node 30 in order to form a control signal or voltage valid signal on output 22. The voltage valid signal is representative of a difference between the output voltage and the internal voltage. The inverting input of comparator 37 is formed to have an offset voltage to facilitate proper operation when amplifier 36 is disabled. Thus, the value of the output voltage must be greater than the value of the internal voltage plus the offset voltage in order for the voltage valid signal to be high. When the enable signal on input 19 is high, the value of the bandgap output voltage on output 21 is greater than the value of the internal voltage on node 30 plus the internal offset voltage of comparator 37, thus, comparator 37 drives the voltage valid signal high. The high voltage valid signal enables transistor 14 to couple the value of the bandgap output voltage to element 13 for storage.

When the enable signal goes low, reference 11 and amplifier 36 are disabled and only leakage current from amplifier 36 flows through resistors 27, 28, and 31 and through transistors 32 and 34. The low enable signal on input 19 also enables transistor 39, through inverter 38, to pull the output of amplifier 36 to the value of return 18 or a low value. The non-inverting input of comparator 37 receives the low value from the output of amplifier 36. Because of the leakage current from amplifier 36, there is a very small voltage on node 30. This small voltage is applied to the inverting input of comparator 37. Because of the offset voltage on the inverting input of comparator 37, this small voltage on node 30 does not trigger comparator 37. The value of the offset voltage is selected to ensure that the leakage current does not trigger comparator 37. In the preferred embodiment, the offset voltage is approximately one hundred (100) milli-volts. Thus, comparator 37 drives the voltage valid signal low indicating that the output voltage on output 21 is not valid and should not be used. The low voltage valid signal disables transistor 14 and element 13 is disconnected from output 21 thereby maintaining the value of the voltage stored on element 13. It should be noted that comparator 37 has to work when the input voltages received by comparator 37 are close to the value of return 18 as can be seen from the previous explanation. Designs to operate with such voltages are well known to those skilled in the art.

In order to facilitate this operation, the output of amplifier 36 is connected to a first terminal of resistor 27 and to a first terminal of resistor 31. A second terminal of resistor 27 is connected to node 29 and to a first terminal of resistor 28. An emitter of transistor 32 is connected to a second terminal of resistor 28. A collector and a base of transistor 32 are connected to voltage return 18. A second terminal of resistor 31 is connected to node 30 and to an emitter of transistor 34. A base and a collector of transistor 34 are connected to return 18. A non-inverting input of amplifier 36 is connected to node 30 and an inverting input is connected to node 29 while the output is connected to output 21 and to a non-inverting input of comparator 37. Enable input 35 of amplifier 36 is connected to input 19. An inverting input of comparator 37 is connected to node 30 while the output of comparator 37 connected to output 22. A source of transistor 39 is connected to return 18, a drain is connected to the non-inverting input of comparator 37, and a gate is connected to an output of inverter 38. An input of inverter 38 is connected to input 19. The drain of transistor 14 is connected to output 21 and the source is connected to a non-inverting input of amplifier 16 and to a first terminal of element 13. A gate of transistor 14 is connected to output 22 and to timing circuit 12. A second terminal of element 13 is connected to return 18. A non-inverting input of amplifier 16 connected to an output of amplifier 16 and to output 15. An output of timing circuit 12 is connected to input 19. Those skilled in the art will understand that amplifier 36, comparator 37, and inverter 38 are coupled to receive operational power from input 17 and return 18.

The particular bandgap cell that is used within reference 11 may be any one of many different well know bandgap designs. Two such designs are illustrated in FIG. 2 and FIG. 3.

Figure 2:
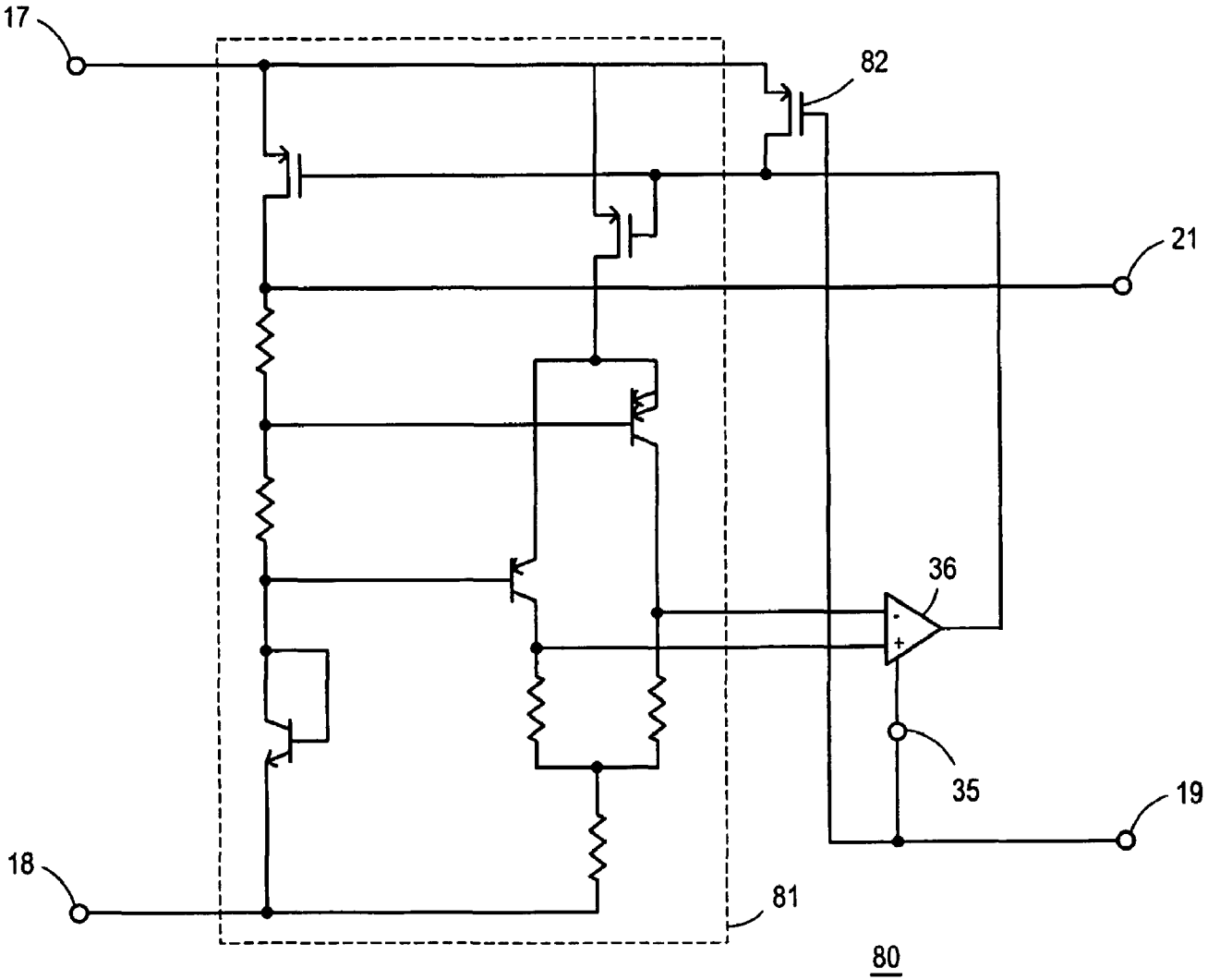
FIG. 2 schematically illustrates a portion of an alternate embodiment of a portion of the bandgap reference generator of FIG. 1 in accordance with the present invention.

FIG. 2 schematically illustrates a portion of a bandgap reference 80 that is an alternate embodiment of reference 11 that is explained in the description of FIG. 1. Reference 80 includes a bandgap cell 81 that is an alternate embodiment of cell 33 that is explained in the description of FIG. 1. A disable transistor 82 is used to connect the output of amplifier 36 to input 17 when amplifier 36 is disabled. Cell 81 and the operation thereof is well known to those skilled in the art. In some embodiments, cell 81 may be used for cell 33 in generator 10 of FIG. 1.

Figure 3:
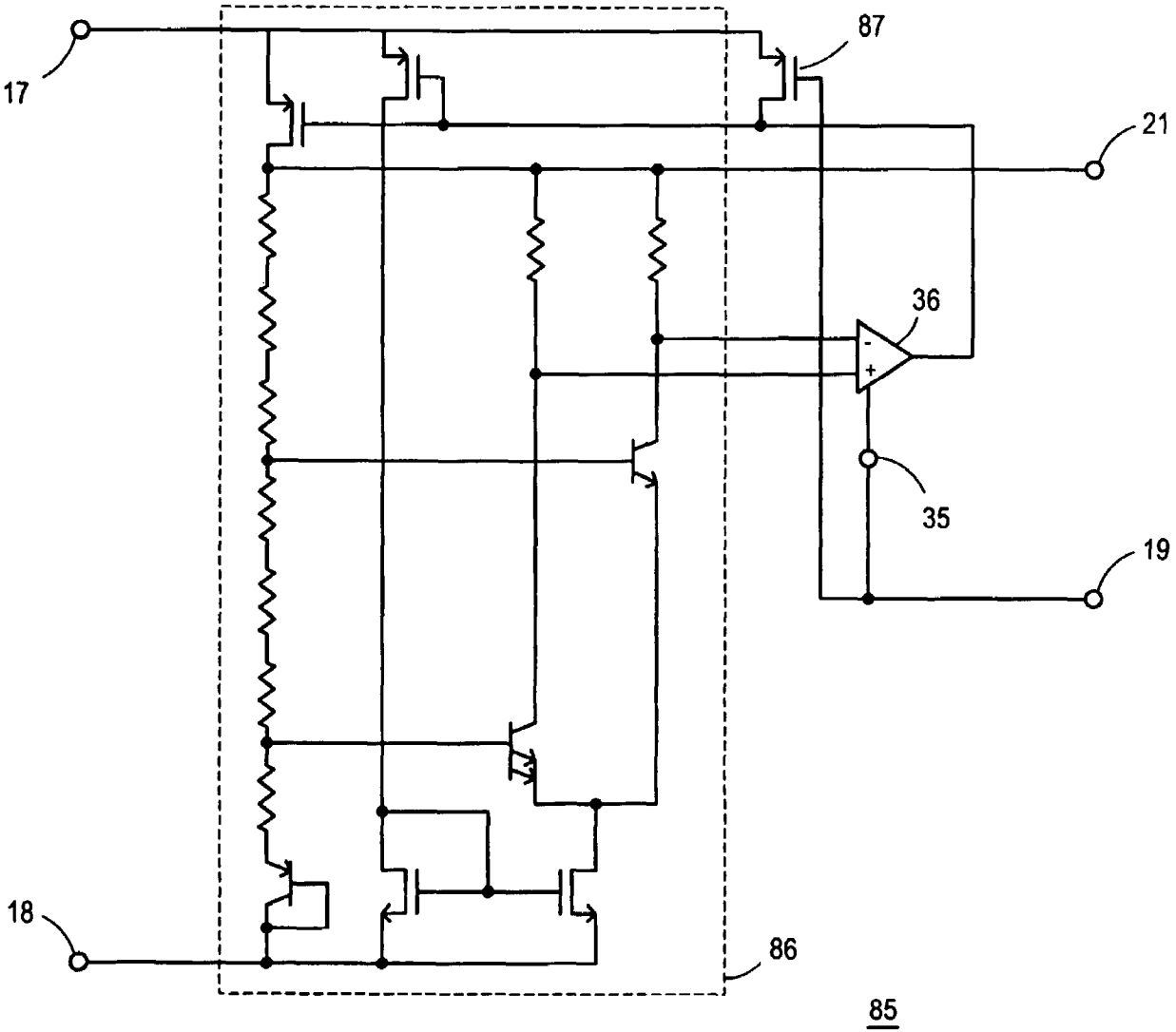
FIG. 3 schematically illustrates a portion of another alternate embodiment of a portion of the bandgap reference generator of FIG. 1 in accordance with the present invention.

FIG. 3 schematically illustrates a portion of a bandgap reference 85 that is an alternate embodiment of reference 11 that is explained in the description of FIG. 1. Reference 85 includes a bandgap cell 86 that is an alternate embodiment of cell 33 that is explained in the description of FIG. 1. A disable transistor 87 is used to connect the output of amplifier 36 to input 17 when amplifier 36 is disabled. Cell 86 and the operation thereof is well known to those skilled in the art. In some embodiments, cell 86 may be used for cell 33 in generator 10 of FIG. 1.

Figure 4:
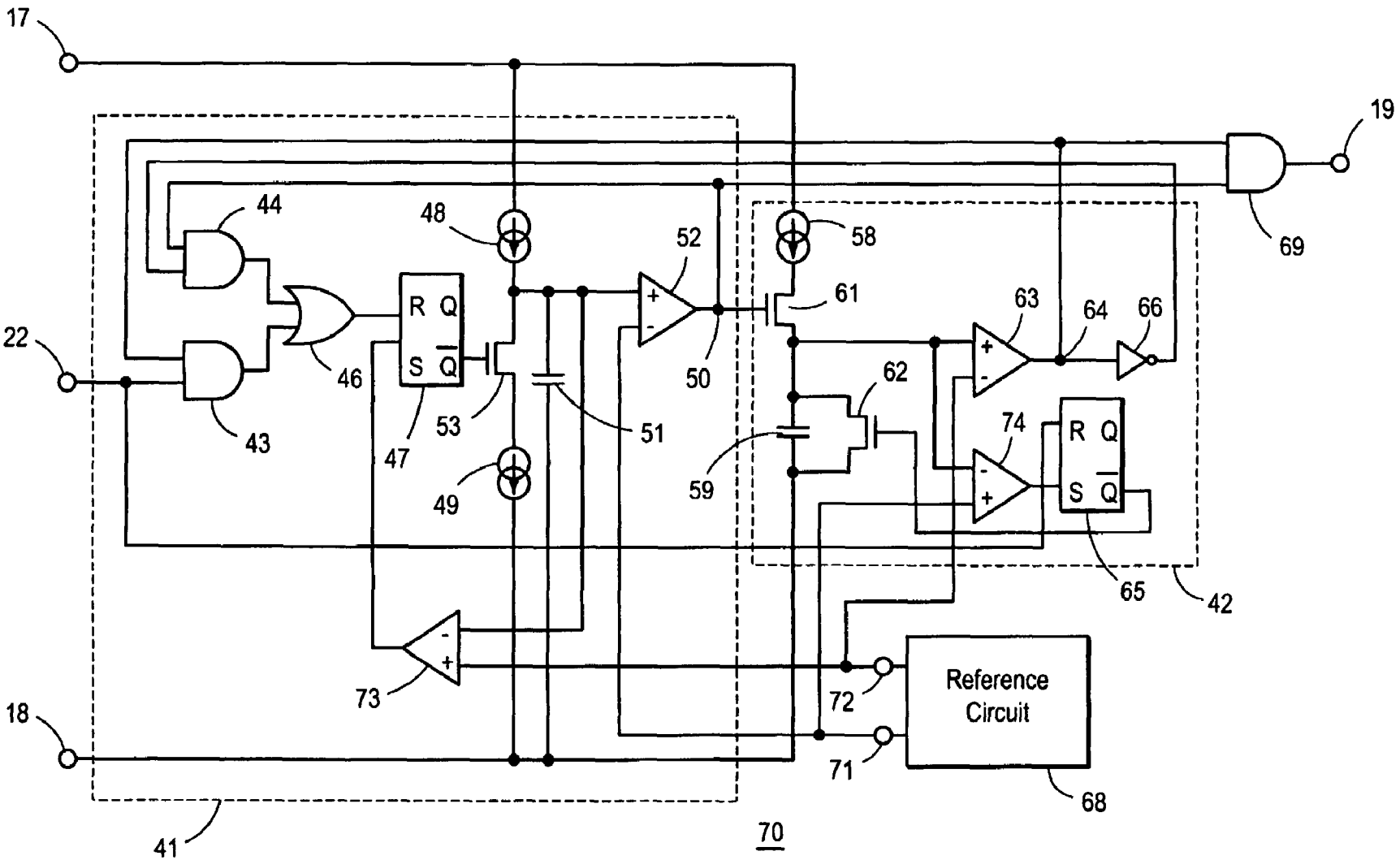
FIG. 4 schematically illustrates an embodiment of a portion of the bandgap reference generator of FIG. 1 in accordance with the present invention.

FIG. 4 schematically illustrates a portion of a timing circuit 70 that is a preferred embodiment of timing circuit 12 that is explained in the description of FIG. 1. Circuit 12 includes an analog relaxation oscillator 41, and an analog pulse shaper 42 that are utilized to form the low duty cycle enable signal that is applied to input 19. Circuit 70 is formed to provide low power dissipation and low current consumption in order to minimize the power dissipated by generator 10 (see FIG. 1). Those skilled in the art will understand that a digital implementation or other implementations may be utilized as long as the enable signal provides a low duty cycle for generator 10. However, as is well known the analog implementation of circuit 70 provides a more controlled power dissipation than would a digital implementation because of the various frequency related power dissipation components of a digital implementation. A reference circuit 68 of circuit 70 provides threshold voltages that are used by oscillator 41 and shaper 42. Circuit 68 provides a first threshold voltage or low threshold voltage on an output 71 and a second threshold voltage or high threshold voltage on an output 72.

Oscillator 41 includes a current source 48 and a current source 49 that are used to charge and discharge, respectively, a capacitor 51 at a very controlled rate to form the oscillation frequency of oscillator 41. Shaper 42 includes a capacitor 59 that is charged by the pulses of oscillator 41, a current source 58 that is used to charge capacitor 59 at a very controlled rate, and switch transistors 61 and 62 that are used to charge and discharge, respectively, capacitor 59. In general, oscillator 41 runs at a predetermined frequency and generates a narrow pulse during each cycle of the oscillation. Each pulse increases the charge on a capacitor 59 of shaper 42. When the voltage stored on capacitor 59 reaches a certain voltage, shaper 42 generates a pulse that is used to form the enable signal that is applied to input 19.

Assume that an RS flip-flop 47 is set and a transistor 53 is disabled. Current source 48 is utilized to charge capacitor 51 at a very controlled rate. When the voltage on capacitor 51 reaches the high threshold value, the output of comparator 52 goes high driving node 50 high. The high on node 50 enables transistor 61 to begin charging capacitor 59. Note that node 64 is low and the output of an inverter 66 is high, thus, the high from node 50 is applied to flop 47. The high on node 50 also resets flop 47 through gates 44 and 46, driving the Q bar output of flop 47 goes high enabling transistor 53 to begin discharging capacitor 51. When capacitor 51 discharges to the high threshold value, node 50 goes low and disables transistor 61 to stop the charging of capacitor 59. The delay from node 50 through gates 44 and 46 and through flop 47 and through comparator 52 sets the amount of time that transistor 61 is enabled to charge capacitor 59. This delay is generally very small compared to the period of oscillator 41, thus, a very small charge is applied to capacitor 59 during each pulse of oscillator 41. The oscillations of oscillator 41 continue until capacitor 59 is charged to a voltage value that is at least equal to the high threshold value on output 72. This voltage value is received by comparator 63 which drives the output of comparator 63 and a node 64 high. Note that node 50 is also high at this time since oscillator 41 is in the process of Appling another charge to capacitor 59. The high on nodes 64 and 50 enable an AND gate 69 to generate the enable signal to input 19. At the same time, the high on node 64 causes the output of inverter 66 to go low and disable gate 44 thereby preventing the high on node 50 from resetting flop 47. Circuit 70 remains in this state until receiving the voltage valid signal from reference 11. The voltage valid signal on output 22 resets flop 65 causing the Q output to go low and enable transistor 62 to discharge capacitor 59. When the voltage on capacitor 59 is discharged below the high threshold value, the output of comparator 63 goes low which removes the enable signal from input 19 and also removes the low from gate 44 allowing the high on node 50 to reset flop 47. When the voltage on capacitor 59 reaches the low threshold value, the output of comparator 74 goes high to set flop 65 and disable transistor 62 thereby enabling shaper 42 to once again charge capacitor 59 responsively to oscillator 41. Forming oscillator 41 to delay until receiving the voltage valid signal ensures that the output of reference 11 reaches a valid operating value. Delaying a time period after receiving the voltage valid signal provides time for charging element 13 prior to removing the enable signal.

In one example generator 10 was formed to provide a reference voltage of approximately 1.2 volts on output 15 and to operate at a 2.2% duty cycle. The enable signal had a pulse width of about forty (40) micro-seconds and a period of about two (2) milli-seconds. Current through resistor 28 was formed to be approximately five (5) micro-amps when reference 11 was enabled and generator 10 correspondingly consumed a current of about thirty (30) micro-amps. With reference 11 disabled, generator 10 consumed a current of about ten (10) nano-amps. The total average current consumption of generator 10 was about 0.6 micro-amps. Consequently, reference 11 used a large current through transistors 32 and 34 in order to form a reliable reference voltage, and consumed a small amount of current when disabled in order to lower the total power dissipation. Additionally at these current levels, the pole of generator 10 was at a frequency greater than about one Kilo-Hertz (1 KHz) which improved the PSRR of generator 10.

Figure 5:
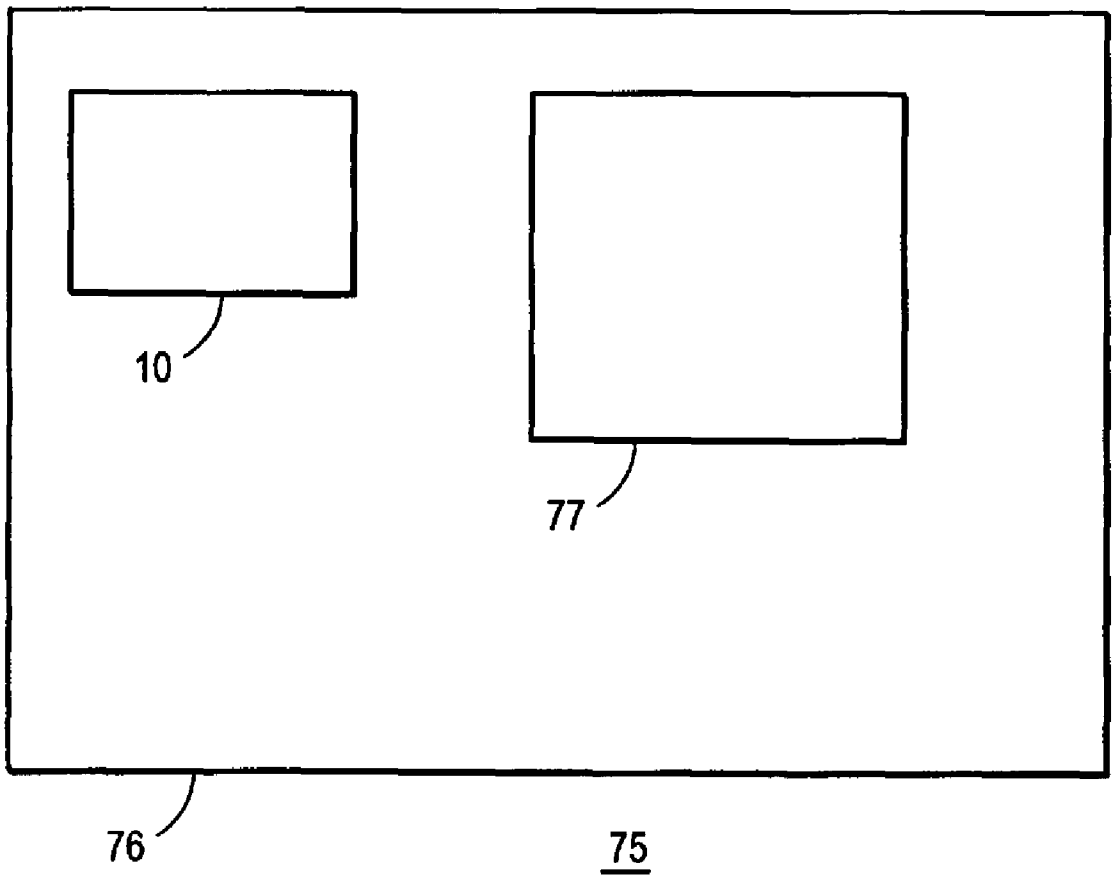
FIG. 5 schematically illustrates an enlarged plan view of a semiconductor device in accordance with the present invention.

FIG. 5 schematically illustrates an enlarged plan view of a portion of an embodiment of a semiconductor device 75 that is formed on a semiconductor die 76. Generator 10 is formed on die 76 along with a load 77 that utilizes the reference voltage formed by generator 10.

In view of all of the above, it is evident that a novel device and method is disclosed. Included, among other features, is forming a voltage reference to operate a bandgap reference cell at a duty cycle that is less than one hundred percent. Forming the voltage reference to operate at a high current level when enabled minimizes the low current effects from the reference voltage. The high current consumption minimizes the leakage current effects and also improves the power supply rejection ratio. Thus, the low duty cycle operation reduces the power dissipation of the reference generator and improves the accuracy of the reference voltage.

While the invention is described with specific preferred embodiments, it is evident that many alternatives and variations will be apparent to those skilled in the semiconductor arts. For example, the enable signal may be formed by various pulse generator implementations. Additionally, the bandgap cell may use any one of many different implementations to form the reference voltage when the bandgap cell is enabled.

The invention claimed is:

1. A method of forming a reference voltage generator comprising:

forming a bandgap circuit to be enabled to generate a reference voltage having a value during a first time period and to couple a storage device to the bandgap circuit and store the value of the reference voltage on the storage device responsively to the first time period;

forming the bandgap circuit to be disabled during a second time period; and forming the reference voltage generator to decouple the storage device from receiving the reference voltage responsively to the second time period.

2. The method of claim 1 wherein forming the bandgap circuit to be enabled to generate the reference voltage having the value during the first time period includes forming the bandgap circuit to be operated at a duty cycle that is less than one hundred percent.

3. The method of claim 2 wherein forming the bandgap circuit to be operated at the duty cycle that is less than one hundred percent includes forming the band gap circuit to operate at the duty cycle that is less than fifty percent.

4. The method of claim 3 wherein forming the bandgap circuit to be operate at the duty cycle that is less than fifty percent includes forming the band gap circuit to operate at the duty cycle that is less than three percent.

5. The method of claim 1 wherein forming the bandgap circuit to be enabled to generate the reference voltage during the first time period includes forming the bandgap circuit to generate a second voltage having a value that is less than the value of the reference voltage during the second time period.

6. The method of claim 1 wherein forming the bandgap circuit to be enabled to generate the reference voltage having the value during the first time period includes forming the bandgap circuit to enable a selectable reference amplifier of the bandgap circuit during the first time period and to disable the selectable reference amplifier during the second time period.

7. The method of claim 1 including forming a storage device coupled to receive the wherein forming the reference voltage generator to decouple the storage device from receiving the reference voltage responsively to the second time period includes forming the reference voltage generator to retain the value on the storage device during the second time period.

8. The method of claim 7 further including forming an amplifier coupled to receive the value from the storage device during the first time period and the second time period.

9. The method of claim 1 wherein forming the bandgap circuit to be enabled to generate the reference voltage having the value during the first time period includes forming a timing circuit to generate a pulse having a duty cycle.

10. A method of generating a reference voltage comprising:

coupling a bandgap reference circuit to receive operating current and to responsively generate a reference voltage having a first value during a first interval of an operating cycle of the bandgap reference circuit, and decoupling the bandgap reference circuit from receiving the operating current and responsively inhibit generating the first value during a second interval of the operating cycle wherein the first interval of the operating cycle is less than one hundred percent.

11. The method of claim 10 wherein decoupling the bandgap reference circuit from receiving the operating current and responsively inhibit generating the first value includes coupling the bandgap reference circuit to generate a second value that is less than the first value responsively to the second interval.

12. The method of claim 10 further including coupling the bandgap reference circuit to a storage element responsively to the first interval and storing the first value on the storage element, and decoupling the storage element from the bandgap reference circuit and retaining the first value on the storage responsively to the second interval.

13. The method of claim 12 further including coupling the storage element to an amplifier having a high input impedance.

14. The method of claim 10 wherein coupling the bandgap reference circuit to receive the operating current and to responsively generate the reference includes enabling a selectable reference amplifier during the first interval wherein the selectable reference amplifier provides the operating current to the bandgap reference circuit, and disabling the selectable reference amplifier after the first interval expires.

15. The method of claim 10 further including configuring a timing circuit to form a timing signal having an asymmetrical waveform and using the timing signal for coupling the bandgap reference circuit to receive the operating current.

16. A reference voltage device comprising:

a selectable reference amplifier having an output, a first input, and a second input;

a first reference transistor having a first current carrying electrode coupled to receive current from the selectable reference amplifier through a first and second series connected resistors wherein the second series connected resistor is coupled to supply a voltage to the first input of the selectable reference amplifier;

a second reference transistor having a first current carrying electrode coupled to receive current from the selectable reference amplifier through a third series connected resistor wherein the third series connected resistor is coupled to supply a voltage to the second input of the selectable reference amplifier; and a timing circuit coupled to provide a timing signal to selectively enable and disable the selectable reference amplifier.

17. The reference voltage device of claim 16 further including a comparator coupled to receive an output voltage from the output of the selectable reference amplifier and an internal voltage from the first current carrying electrode of the second reference transistor and to responsively generate a control signal representative of a difference between the output voltage and the internal voltage.

18. The reference voltage device of claim 17 further including a transistor coupled to receive the output voltage and to transfer the output voltage to a storage element responsively to the control signal.

19. The reference voltage device of claim 16 wherein the first reference transistor and the second reference transistor are transistors within a bandgap reference circuit.

* * * * *